US008429916B2

(12) United States Patent
Rudrapatna et al.

(10) Patent No.: US 8,429,916 B2
(45) Date of Patent: Apr. 30, 2013

(54) DUAL WALLED COMBUSTORS WITH IMPROVED LINER SEALS

(75) Inventors: Nagaraja S. Rudrapatna, Chandler, AZ (US); Paul Yankowich, Phoenix, AZ (US); Amy Hanson, Peoria, AZ (US)

(73) Assignee: Honeywell International Inc., Morristown, NJ (US)

( * ) Notice: Subject to any disclaimer, the term of this patent is extended or adjusted under 35 U.S.C. 154(b) by 718 days.

(21) Appl. No.: 12/623,773

(22) Filed: Nov. 23, 2009

(65) Prior Publication Data

US 2011/0120133 A1 May 26, 2011

(51) Int. Cl.
*F23D 14/46* (2006.01)
*F23R 3/60* (2006.01)

(52) U.S. Cl.
USPC ..... 60/752; 60/755; 60/799; 60/800; 277/641; 277/644

(58) Field of Classification Search ..... 60/752, 60/754, 755, 756, 758, 799, 800; 277/471, 277/641, 644
See application file for complete search history.

(56) References Cited

U.S. PATENT DOCUMENTS 3,965,066 A 6/1976 Sterman et al.
4,785,623 A 11/1988 Reynolds
5,289,677 A 3/1994 Jarrell
5,291,732 A 3/1994 Halila
5,570,573 A * 11/1996 Bonnelie ..... 60/253
5,682,747 A 11/1997 Brown et al.
5,704,208 A 1/1998 Brewer et al.
5,758,504 A 6/1998 Abreu et al.
6,079,199 A 6/2000 McCaldon et al.
6,199,871 B1 3/2001 Lampes
6,397,603 B1 6/2002 Edmondson et al.
6,854,738 B2 2/2005 Matsuda et al.
6,895,757 B2 5/2005 Mitchell et al.
7,093,440 B2 8/2006 Howell et al.
7,152,411 B2 12/2006 McCaffrey et al.
7,481,037 B2 1/2009 Takaya et al.
2005/0132716 A1 * 6/2005 Zupanc et al. ..... 60/804
2007/0113557 A1 5/2007 Schumacher et al.

* cited by examiner

*Primary Examiner* — Ehud Gartenberg
*Assistant Examiner* — Steven Sutherland
(74) *Attorney, Agent, or Firm* — Ingrassia Fisher & Lorenz, P.C.

(57) ABSTRACT

A combustor for a turbine engine is provided. The combustor includes a first liner and a second liner forming a combustion chamber. The combustion chamber is configured to receive an air-fuel mixture for combustion therein and having a longitudinal axis that defines axial and radial directions. The first liner is a first dual walled liner having a first hot wall facing the combustion chamber and a first cold wall that forms a first liner cavity with the first hot wall, the first liner cavity having first and second ends. A first liner seal is configured to seal the second end of the first liner cavity and to accommodate relative movement of the first hot wall and first cold wall generally in the axial and radial directions.

16 Claims, 4 Drawing Sheets

DUAL WALLED COMBUSTORS WITH IMPROVED LINER SEALS

TECHNICAL FIELD

The following description generally relates to combustors for gas turbine engines, and more particularly relates to dual walled combustors with liner seals.

BACKGROUND

A gas turbine engine may be used to power various types of vehicles and systems. A particular type of gas turbine engine that may be used to power aircraft is a turbofan gas turbine engine. A turbofan gas turbine engine conventionally includes, for example, five major sections: a fan section, a compressor section, a combustor section, a turbine section, and an exhaust section. The fan section is typically positioned at the inlet section of the engine and includes a fan that induces air from the surrounding environment into the engine and accelerates a fraction of this air toward the compressor section. The remaining fraction of air induced into the fan section is accelerated into and through a bypass plenum and out the exhaust section.

The compressor section raises the pressure of the air it receives from the fan section, and the resulting compressed air then enters the combustor section, where a ring of fuel nozzles injects a steady stream of fuel into a combustion chamber formed between inner and outer liners. The fuel and air mixture is ignited to form combustion gases, which drive rotors in the turbine section for power extraction. The gases then exit the engine at the exhaust section.

Known combustors include inner and outer liners that define an annular combustion chamber in which the fuel and air mixture is combusted. During operation, a portion of the airflow entering the combustor is channeled through the combustor outer passageway for attempting to cool the liners and diluting a main combustion zone within the combustion chamber. Some combustors are dual walled combustors in which the inner and outer liners each have so-called "hot" and "cold" walls. These arrangements may enable impingement-effusion cooling in which cooling air flows through cavities formed between the hot and cold walls. In order to maximize cooling, seals may be provided between the respective hot and cold walls at the forward and aft edges to seal the cavities. Typically, these seals are fixed seals.

A consequence of the dual walled combustor design is the inherent difference in operating temperature between the walls of the liners. For example, the hot walls are subjected to high temperature combustion gases and thermal radiation, resulting in thermal stresses and strains, while the cold walls are shielded from the combustion gases and run much cooler. Differential operating temperatures result in differential thermal expansion and contraction of the combustor components. Such differential thermal movement occurs both axially and radially, as well as during steady state operation and during transient operation of the engine as power is increased and decreased. This movement may particularly cause undesirable leakage or stress issues with the seals of the respective liner walls.

Accordingly, it is desirable to provide combustors with liner seals that accommodate differential thermal movement therebetween, while also minimizing undesirable leakage of cooling air. Furthermore, other desirable features and characteristics of the present invention will become apparent from the subsequent detailed description of the invention and the appended claims, taken in conjunction with the accompanying drawings and this background of the invention.

BRIEF SUMMARY

In accordance with an exemplary embodiment, a combustor for a turbine engine is provided. The combustor includes a first liner and a second liner forming a combustion chamber with the first liner. The combustion chamber is configured to receive an air-fuel mixture for combustion therein and having a longitudinal axis that defines axial and radial directions. The first liner is a first dual walled liner having a first hot wall facing the combustion chamber and a first cold wall that forms a first liner cavity with the first hot wall, the first liner cavity having first and second ends. A first liner seal is configured to seal the second end of the first liner cavity and to accommodate relative movement of the first hot wall and first cold wall generally in the axial and radial directions.

In accordance with another exemplary embodiment, a combustor for a turbine engine is provided. The combustor includes an inner liner and an outer liner forming a combustion chamber with the inner liner. The combustion chamber is configured to receive an air-fuel mixture for combustion therein and having a longitudinal axis that defines axial and radial directions. The inner liner is a dual walled liner having a first hot wall facing the combustion chamber and a first cold wall that forms an inner liner cavity with the first hot wall. The outer liner is a dual walled liner having a second hot wall facing the combustion chamber and a second cold wall that forms an outer liner cavity with the second hot wall, each of the outer and inner liner cavities having first and second ends. An inner liner seal configured to seal the second end of the inner liner cavity and to accommodate relative movement of the first hot wall and first cold wall generally in the axial and radial directions. An outer liner seal configured to seal the second end of the outer liner cavity and to accommodate relative movement of the second hot wall and second cold wall generally in the axial and radial directions.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Broadly, exemplary embodiments discussed herein relate to dual walled combustors. More particularly, inner and outer liners of a dual walled combustor each include hot and cold walls. An inner liner seal is provided at the aft end of the inner liner and an outer liner seal is provided at the aft end of the outer liner. These liner seals provide a seal between the respective walls while accommodating relative axial and radial movements.

Figure 1:
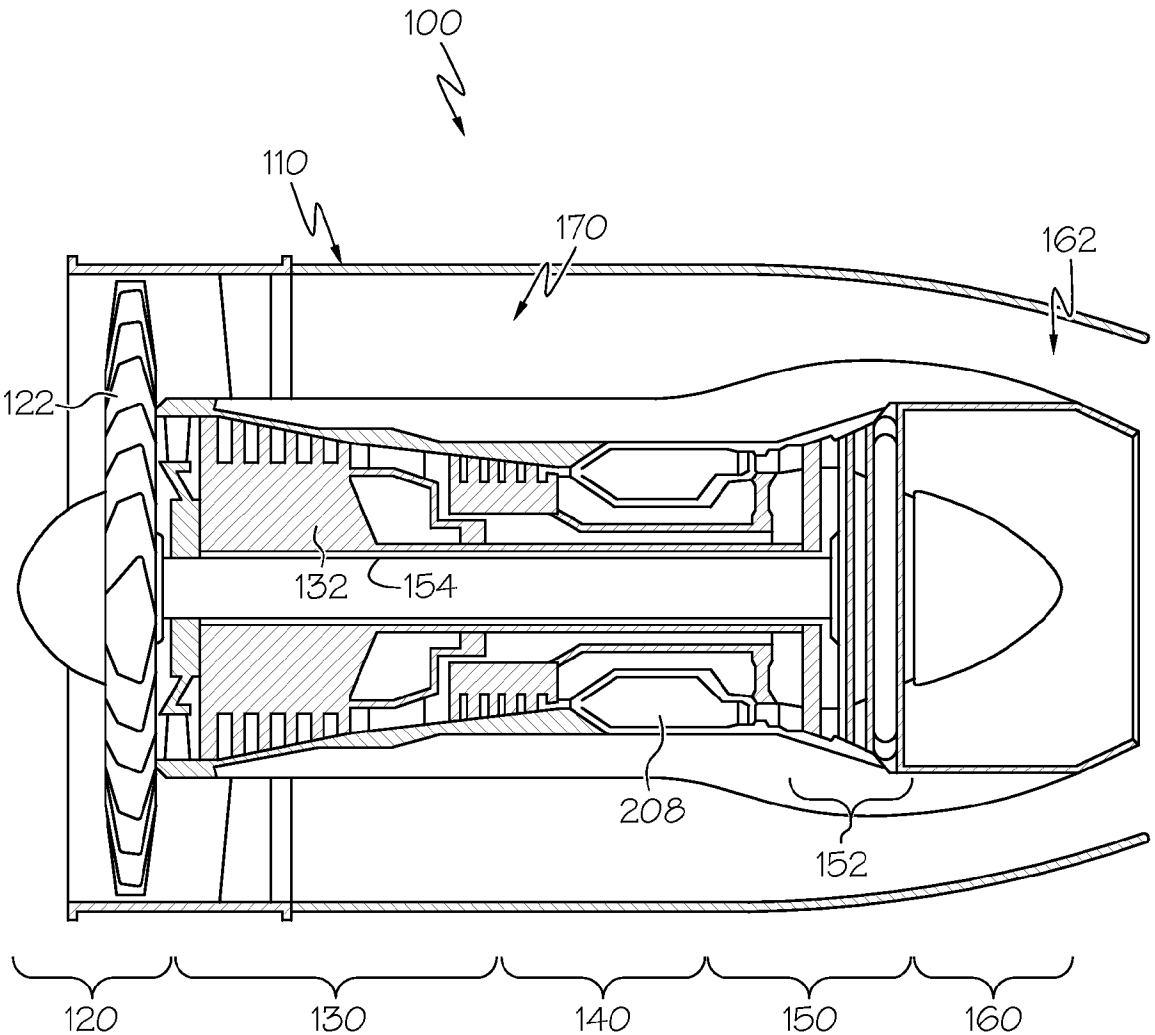
FIG. 1 is a cross-sectional view of a gas turbine engine in accordance with an exemplary embodiment.

FIG. 1 is a cross-sectional view of a gas turbine engine 100, according to an exemplary embodiment. The gas turbine engine 100 can form part of, for example, an auxiliary power unit for an aircraft or a propulsion system for an aircraft. The gas turbine engine 100 may be disposed in an engine case 110 and may include a fan section 120, a compressor section 130, a combustion section 140, a turbine section 150, and an exhaust section 160. The fan section 120 may include a fan 122, which draws in and accelerates air. A fraction of the accelerated air exhausted from the fan 122 is directed through a bypass section 170 to provide a forward thrust. The remaining fraction of air exhausted from the fan 122 is directed into the compressor section 130.

The compressor section 130 may include a series of compressors 132, which raise the pressure of the air directed into it from the fan 122. The compressors 132 may direct the compressed air into the combustion section 140. In the combustion section 140, which includes an annular combustor 208, the high pressure air is mixed with fuel and combusted. The combusted air is then directed into the turbine section 150.

The turbine section 150 may include a series of turbines 152, which may be disposed in axial flow series. The combusted air from the combustion section 140 expands through the turbines 152 and causes them to rotate. The air is then exhausted through a propulsion nozzle 162 disposed in the exhaust section 160, providing additional forward thrust. In an embodiment, the turbines 152 rotate to thereby drive equipment in the gas turbine engine 100 via concentrically disposed shafts or spools. Specifically, the turbines 152 may drive the compressor 132 via one or more rotors 154.

Figure 2:
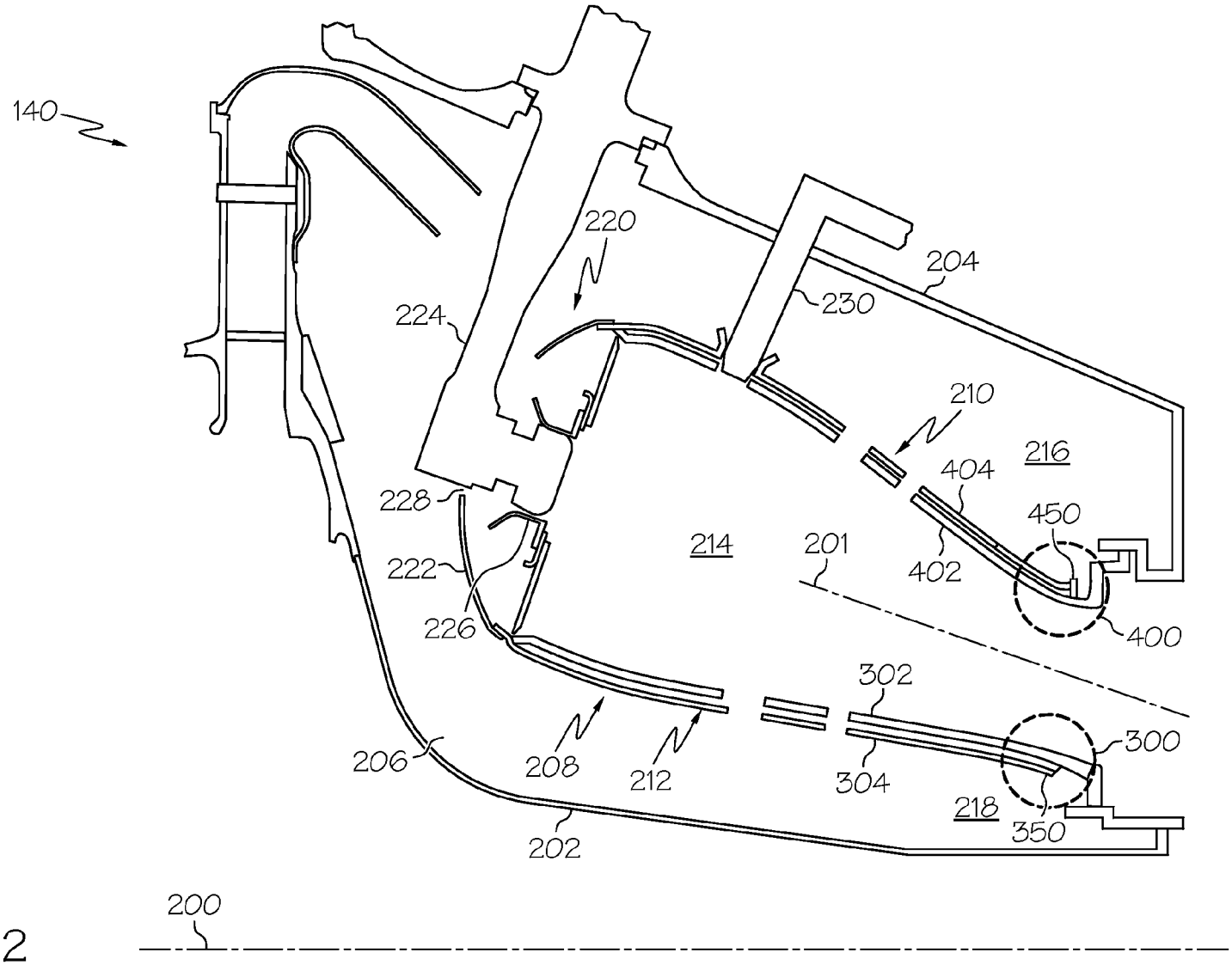
FIG. 2 is a cross-sectional view of a combustor for the gas turbine engine of FIG. 1 in accordance with an exemplary embodiment.

FIG. 2 is a more detailed cross-sectional view of the combustion section 140 of FIG. 1. In FIG. 2, only half the cross-sectional view is shown, the other half being substantially rotationally symmetric about a centerline and axis of rotation 200. Although the depicted combustion section 140 is an annular-type combustion section, any other type of combustor, such as a can combustor, can be provided. The depicted combustor section 140 may be, for example, a rich burn, quick quench, lean burn (RQL) combustor section.

The combustion section 140 comprises a radially inner case 202 and a radially outer case 204 concentrically arranged with respect to the inner case 202. The inner and outer cases 202, 204 circumscribe the axially extending engine centerline 200 to define an annular pressure vessel 206. As noted above, the combustion section 140 also includes the combustor 208 residing within the annular pressure vessel 206.

The combustor 208 is defined by an outer liner 210 and an inner liner 212 that is circumscribed by the outer liner 210 to define an annular combustion chamber 214. The combustion chamber 214 may be considered to have a longitudinal axis 201 that generally defines radial and axial directions. The liners 210, 212 cooperate with cases 202, 204 to define respective outer and inner air plenums 216, 218.

The inner liner 212 is a dual walled liner with a "hot" wall 302 on the side of the combustion chamber 214 and a "cold" wall 304 on the side of the plenum 218. The hot and cold walls 302, 304 define a liner cavity therebetween. In an exemplary embodiment, this dual walled configuration enables improved cooling of the inner liner 212 and/or lead to additional air available for the combustion process and a corresponding decrease in unwanted emissions. In particular, the hot and cold walls 302, 304 may provide impingement-effusion cooling to the inner liner 212. As such, impingement cooling air may flow from the inner plenum 218 through the cold wall 304 at an angle of approximately 90° relative to the cold wall, and the pass through the hot wall 302 as effusion cooling air at an angle of approximately 15°-45° to the surface of the hot wall 302 such that a film of cooling air forms on the hot wall 302.

The hot and cold walls 302, 304 may be annular and continuous, although in further exemplary embodiments, for example, the hot wall 302 may be formed by cooling tiles or heat shields. In general, the hot and cold walls 302, 304 are fixed relative to one another at the forward ends and sealed relative to one another at the aft ends with an inner liner seal 350. As is discussed in greater detail below in reference to FIG. 3, the inner liner seal 350 seals the liner cavity while accommodating relative movement between the hot and cold walls 302, 304 in both the radial and axial directions resulting, for example, from thermal expansions and contractions. In one exemplary embodiment, the inner liner seal 350 only seals the hot and cold walls 302, 304 of the inner liner 212 and is upstream of, and separate from, the seals that couple the combustor section 140 to the turbine section 150 (FIG. 1).

Similar to the inner liner 212, the outer liner 210 shown is a dual walled liner with a "hot" wall 402 on the side of the combustion chamber 214 and a "cold" wall 404 on the side of the plenum 216. The hot and cold walls 402, 404 define a liner cavity therebetween. In an exemplary embodiment, this dual walled configuration enables impingement-effusion cooling of the outer liner 210. As above, impingement cooling air may flow from the outer plenum 216 through the cold wall 404 and pass through the hot wall 402 as effusion cooling air. The hot and cold walls 402, 404 may be annular and continuous, although in further exemplary embodiments, for example, the hot wall 402 may be formed by cooling tiles or heat shields.

In general, the hot and cold walls 402, 404 are fixed relative to one another at the forward ends and sealed relative to one another at the aft ends with an outer liner seal 450. As is discussed in greater detail below in reference to FIG. 4, the outer liner seal 450 seals the liner cavity while accommodating relative movement between the hot and cold walls 402, 404 in both the radial and axial directions resulting, for example, from thermal expansions and contractions. In one exemplary embodiment, the outer liner seal 450 only seals the hot and cold walls 402, 404 of the outer liner 210 and is upstream of, and separate from, the seals that couple the combustor section 140 to the turbine section 150 (FIG. 1).

The combustor 208 additionally includes a front end assembly 220 with a shroud assembly 222, fuel injectors 224, and fuel injector guides 226. One fuel injector 224 and one fuel injector guide 226 are shown in the partial cross-sectional view of FIG. 2. In one embodiment, the combustor 208 includes a total of sixteen circumferentially distributed fuel injectors 224, but it will be appreciated that the combustor 208 could be implemented with more or less than this number of injectors 224. Each fuel injector 224 is secured to the outer case 204 and projects through a shroud port 228. Each fuel injector 224 introduces a swirling, intimately blended fuel and air mixture that supports combustion in the combustion chamber 214. A fuel igniter 230 extends through the outer case 204 and the outer plenum 216, and is coupled to the outer liner 210. It will be appreciated that more than one igniter 230 can be provided in the combustor 208, although only one is illustrated in FIG. 2. The igniter 230 is arranged downstream from the fuel injector 224 and is positioned to ignite the fuel and air mixture within the combustion chamber 214.

During engine operation, airflow exits a high pressure diffuser and deswirler at a relatively high velocity and is directed into the annular pressure vessel 206 of the combustor 208. The airflow enters the combustion chamber 214 through openings in the liners 210, 212, where it is mixed with fuel from the fuel injector 224, and the airflow is combusted after being ignited by the igniter 230. The combusted air exits the combustion chamber 214 and is delivered to the turbine section 150 (FIG. 1) for energy extraction.

Figure 3:
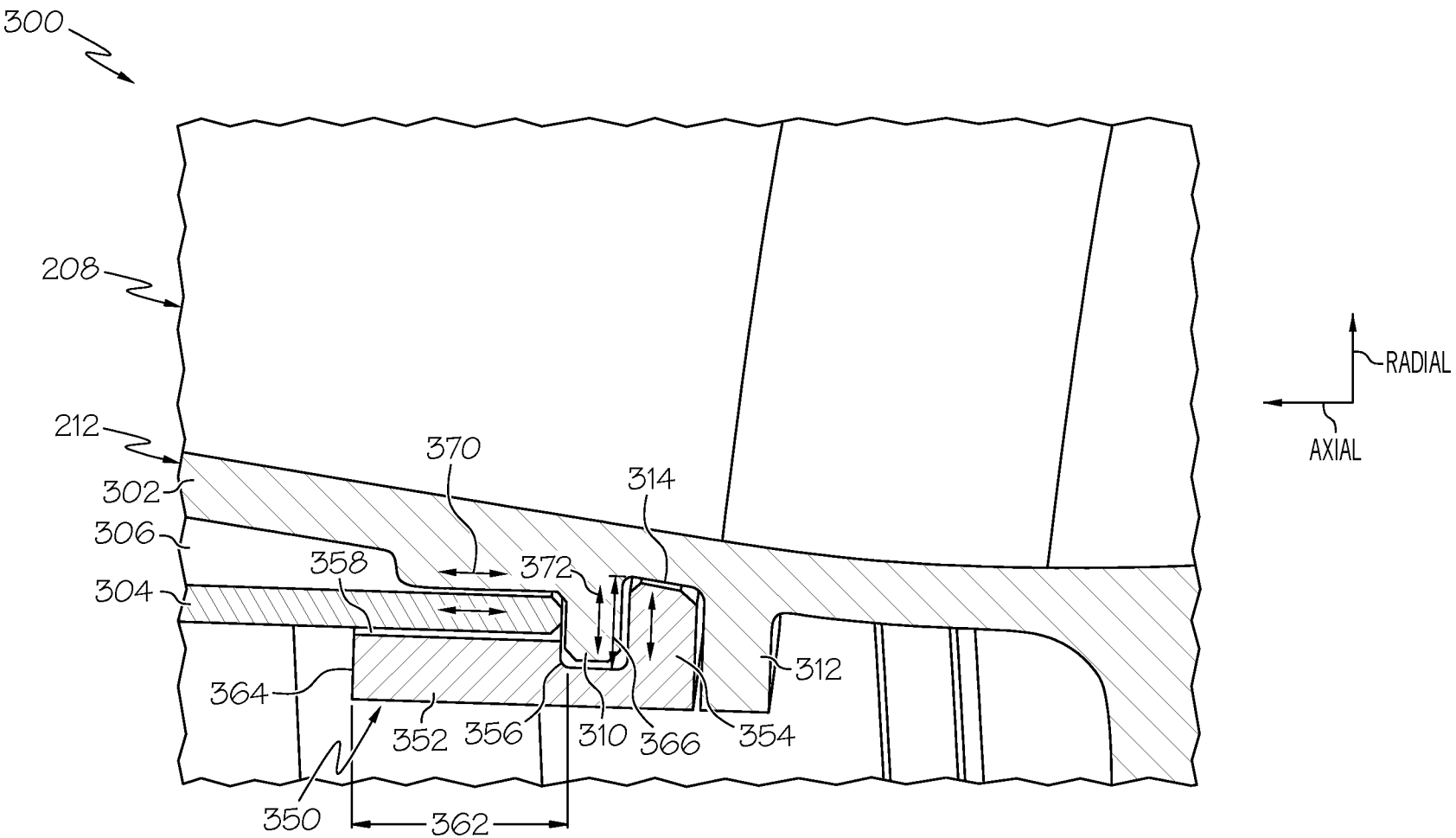
FIG. 3 is an enlarged cross-sectional view of an inner liner seal suitable for use in the combustor of FIG. 2 in accordance with an exemplary embodiment.

FIG. 3 is an enlarged cross-sectional view of an inner liner seal 350 suitable for use in the combustor 208 and generally corresponds to section 300 of FIG. 2 in accordance with an exemplary embodiment. In particular, FIG. 3 shows an aft portion of the hot wall 302 and the cold wall 304 of the inner liner 212, and the inner liner seal 350 functions to seal the aft end of the inner liner cavity 306 formed between the hot wall 302 and the cold wall 304. In general, the hot wall 302 of the inner liner 212 may include first and second radial flanges 310, 312. The first and second radial flanges 310, 312 cooperate to form a hot wall groove 314.

The inner liner seal 350 is generally an annular, single-piece seal and includes an axial main body 352 and a radial flange 354. The axial main body 352 defines a groove 356. In general, the radial flange 354 is positioned within the hot wall groove 314 to retain the inner liner seal 350 in an axial direction relative to the hot wall 302. The first radial flange 310 of the hot wall 302 is also positioned within the inner liner seal groove 356 to additionally retain the inner liner seal 350 in an axial direction relative to the hot wall 302. The inner liner seal 350 and hot wall 302 further define a seal cavity 358 extending generally in an axial direction. The aft end of the cold wall 304 is positioned within the seal cavity 358 to retain the cold wall 304 in a radial direction relative to the inner liner seal 350.

In one exemplary embodiment, the inner liner seal 350 is a split ring seal with ends that may be separated for installation over the hot and cold walls 302, 304 of the inner liner 212. The two ends may then be welded or otherwise attached together to complete the installation. Other installation mechanisms may also be provided. For example, the annular inner liner seal 350 may actually have two or more pieces that are arranged around the hot and cold walls 302, 304 of the inner liner 212. In this alternate embodiment, the ends of the multi-piece inner liner seal 350 may then be welded or otherwise attached to complete the installation.

As noted above, the hot and cold wall 302, 304 may have relative movement to one another in both the radial and axial directions as a result of, for example, temperature differentials. The inner liner seal 350 is configured to accommodate this relative movement.

In particular, the cold wall 304 is not fixed in an axial direction relative to the inner liner seal 350 and the hot wall 302. As such, the cold wall 304 may slide in an axial direction within the seal cavity 358, as indicated by arrows 370. This accommodates relative axial movement of the hot wall 302 and the cold wall 304. The cold wall 304 may have a relative movement of a first distance 362 and still be retained in a radial direction. In one exemplary embodiment, the first distance 362 may be the distance from the first radial flange 310 to a forward edge 364 of the inner liner seal 350.

Additionally, the hot wall 302 is not fixed in a radial direction relative to the inner liner seal 350 and the cold wall 304. As such, the first and second radial flanges 310, 312 of the hot wall 302 may slide in a radial direction, as indicated by arrows 372, relative to the radial flange 354 of the inner liner seal 350. This accommodates relative radial movement of the hot wall 302 and the cold wall 304. The cold wall 304 may have a relative movement of a second distance 366 and still be retained in a radial direction. In one exemplary embodiment, the second distance 366 may be the depth of the hot wall groove 314 of the hot wall 302. Accordingly, the inner liner seal 350 accommodates the relative movement between the hot and cold walls 302, 304 while maintaining the seal at the aft end of the inner liner cavity 306 to minimize leakage of cooling air and provide improved cooling effectiveness. The freedom of axial and radial movements may additionally relieve thermal stresses.

Figure 4:
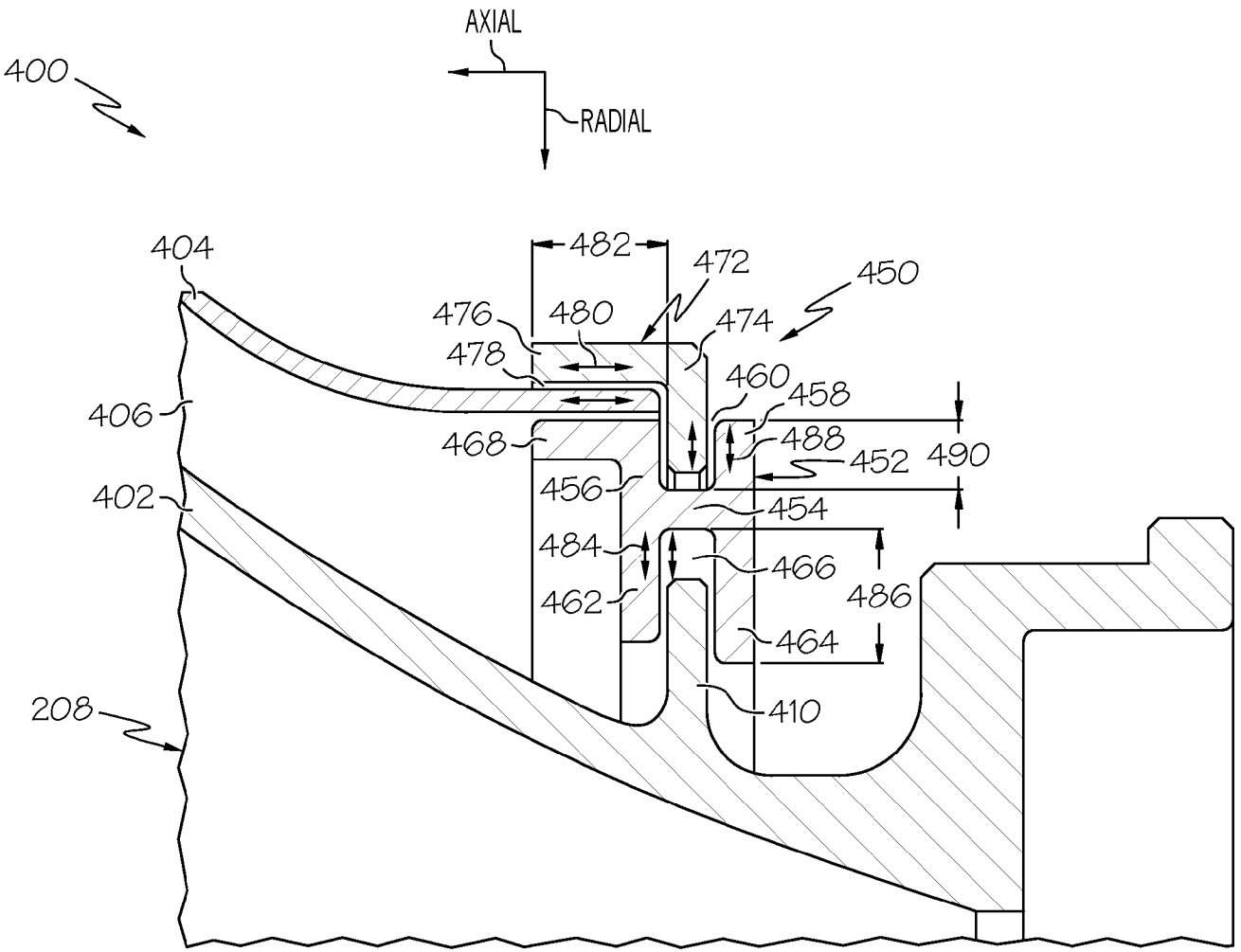
FIG. 4 is an enlarged cross-sectional view of an outer liner seal suitable for use in the combustor of FIG. 2 in accordance with an exemplary embodiment.

FIG. 4 is an enlarged cross-sectional view of an outer liner seal 450 suitable for use in the combustor 208 and generally corresponds to section 400 of FIG. 2 in accordance with an exemplary embodiment. In particular, FIG. 4 shows an aft portion of the hot wall 402 and the cold wall 404 of the outer liner 210, and the outer liner seal 450 functions to seal the aft end of the outer liner cavity 406 formed between the hot wall 402 and the cold wall 404. In general, the hot wall 402 of the outer liner 210 may include a radial flange 410.

The outer liner seal 450 is generally an annular, two-piece seal and includes a first outer liner seal portion 452 and a second outer liner seal portion 472. The first outer liner seal portion 452 generally has a cross-sectional H-shape with a cross piece 454. The first outer liner seal portion 452 has a forward outer flange 456 and an aft outer flange 458 extending in a radial direction from the cross piece 454 and defining an outer radial groove 460. The first outer liner seal portion 452 further has a forward inner flange 462 and an aft inner flange 464 extending in a radial direction from the cross piece 454 and defining an inner radial groove 466. The first outer liner seal portion 452 additionally includes an axial flange 468 extending in a forward axial direction from the forward outer flange 456. As shown, the radial flange 410 of the hot wall 402 is positioned within the inner radial groove 466 to retain the first outer liner seal portion 452 and hot wall 402 relative to one another in an axial direction.

The outer liner seal 450 further includes the second outer liner seal portion 472. The second outer liner seal portion 472 generally has a cross-sectional L-shape. The second outer liner seal portion 472 has a radial leg 474 and an axial leg 476. The axial leg 476 of the second outer liner seal portion 472 and the axial flange 468 of the first outer liner seal portion 452 define an axial cavity 478. The aft end of the cold wall 404 is positioned within the axial cavity 478, and the radial leg 474 of the second outer liner seal portion 472 is positioned within the outer radial groove 460.

In one exemplary embodiment, the first and second outer liner seal portions 452, 472 are a split ring seal portions that may have ends that separate for appropriate installation over the hot and cold walls 402, 404 of the outer liner 210. Particularly, the first outer liner seal portion 452 is installed on the hot wall 402, and the two ends of the first outer liner seal portion 452 may then be welded or otherwise attached together to complete the installation of the first outer liner seal portion 452. The cold wall 404 is then positioned over the hot wall 402 and first outer liner seal portion 452. Finally, the second outer liner seal portion 472 is installed over the cold wall 404 and the first outer liner seal portion 452. The two ends of the second outer liner seal portion 472 may then be welded or otherwise attached together to complete installation of the outer liner seal portion 472 and the outer liner seal 450. Other installation arrangements may also be provided. For example, the annular first and second outer liner seal portions 452, 472 may actually have two or more pieces that are arranged around the hot and cold walls 402, 404 of the outer liner 210. In this alternate embodiment, the ends of the multi-piece outer liner seal portions 452, 472 may then be welded or otherwise attached to complete the installation.

As noted above, the hot and cold walls 402, 404 may have relative movement to one another in both the radial and axial directions as a result of, for example, temperature differentials. The outer liner seal 450 is configured to accommodate this relative movement.

For example, the cold wall 404 is not fixed in an axial direction relative to the first outer liner seal portion 452 and the hot wall 402. In particular, the cold wall 404 slides within the axial cavity 478 as indicated by arrows 480. This accommodates relative axial movement of the hot wall 402 and the cold wall 404. The cold wall 404 may have a relative movement of a first distance 482 and still be retained in a radial direction. In one exemplary embodiment, the first distance 482 may be the depth of the axial cavity 478.

Additionally, neither the hot wall 402 nor the cold wall 404 is fixed in a radial direction relative to the first outer liner seal portion 452. In particular, the radial flange 410 of the hot wall 402 slides within the inner radial groove 466 as indicated by arrows 484. This accommodates relative radial movement between the hot wall 402 and the cold wall 404. The cold wall 404 may have a movement of a second distance 486 relative to the first outer liner seal portion 452 and still be retained in an axial direction. In one exemplary embodiment, the second distance 486 may be the depth of the inner radial groove 466. The radial leg 474 of the second outer liner seal portion 472 may also slide within the outer radial groove 460 of the first outer liner seal portion 452, as indicated by arrows 488. This also accommodates relative radial movement between the hot wall 402 and cold wall 404, particularly radial movement at a third distance 490 between the cold wall 404 and the first outer liner seal portion 452. In one exemplary embodiment, the third distance 490 may be the depth of the outer radial groove 460. Accordingly, the outer liner seal 450 accommodates the relative movement between the hot and cold walls 402, 404 while maintaining the seal at the aft end of the outer liner cavity 406 to minimize leakage of cooling air and provide improved cooling effectiveness. The freedom of axial and radial movements may additionally relieve thermal stresses.

Accordingly, as a result of the sealing arrangements provided by the inner and outer liner seals 350, 450, cooling characteristics of the liners 210, 212 may be improved. Particularly, the liners 210, 212 may achieve a lower temperature, which will enable the combustion process to advantageously occur at higher temperatures. Additionally, the inner and outer liners seal 300, 400 enable effective impingement-effusion cooling. As a result, a reduced amount of air can be used to effectively cool the liners 210, 212. Reduced temperatures may result in lower thermal stresses and improved component life in a cost-effective and reliable manner. In some embodiments, the inner and outer liner seals 350, 450 may provide satisfactory cooling with reduced weight, parts count and cost as compared with conventional arrangements. In various embodiments, the inner and outer liner seals 350, 450 may be used in combination with one another or individually. Different configurations and arrangements of the inner and outer liner seals 350, 450 can be provided as necessary in dependence on the desired temperature of the respective liner 210, 212 and the sensitivity of the combustor 208 to additional cooling air. Exemplary embodiments may find beneficial uses in many industries, including aerospace and particularly in high performance aircraft, as well as automotive and electrical generation.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A combustor for a turbine engine, comprising:

a first liner;

a second liner forming a combustion chamber with the first liner, the combustion chamber configured to receive an air-fuel mixture for combustion therein and having a longitudinal axis that defines axial and radial directions, the first liner being a first dual walled liner comprising a first hot wall facing the combustion chamber and a first cold wall that forms a first liner cavity with the first hot wall, the first liner cavity having first and second ends; and a first liner seal configured to seal the second end of the first liner cavity and to accommodate relative movement of the first hot wall and first cold wall generally in the axial and radial directions, the second liner being a second dual walled liner comprising a second hot wall facing the combustion chamber and a second cold wall that forms a second liner cavity with the second hot wall, the second liner cavity having first and second ends; and a second liner seal configured to seal the second end of the second liner cavity and to accommodate relative movement of the second hot wall and second cold wall generally in the axial and radial directions, wherein the second hot wall includes radially extending second hot wall flange, and wherein the second liner seal comprises first and second portions, the first portion of the second liner seal having a first inner flange and a second inner flange that define an inner groove, the second hot wall flange being positioned within the inner groove of the second liner seal, wherein the first portion of the second liner seal further includes a first outer flange and a second outer flange that define an outer groove, wherein the second liner seal further includes a second portion with a first leg and a second leg extending perpendicularly to the first leg, and wherein the first leg of the second portion is positioned within the outer groove of the second liner seal such that the second portion is movable within the outer groove of the second liner seal generally in the radial direction and is generally retained by the first and second outer flanges of the second liner seal in the axial direction.

2. The combustor of claim 1, wherein the first hot wall includes radially extending first and second hot wall flanges that define a first hot wall groove, and wherein the first liner seal includes a radially extending liner seal flange positioned within the first hot wall groove.

3. The combustor of claim 2, wherein the liner seal flange is movable within the first hot wall groove relative to the first and second hot wall flanges generally in the radial direction and is generally retained by the first and second hot wall flanges in the axial direction.

4. The combustor of claim 3, wherein the first liner seal and the first hot wall define a first axial cavity, and wherein one end of the first cold wall is positioned within the first axial cavity.

5. The combustor of claim 4, wherein the first cold wall is movable within the first axial cavity relative to the first hot wall and first liner seal generally in the axial direction and is generally retained by the first hot wall and first liner seal in the radial direction.

6. The combustor of claim 2, wherein the first liner seal and the first hot wall define a first axial cavity, one end of the first cold wall being positioned within the first axial cavity, and wherein the first cold wall is movable within the first axial cavity relative to the first hot wall and first liner seal generally in the axial direction and is generally retained by the first hot wall and first liner seal in the radial direction.

7. The combustor of claim 1, wherein the first liner is an inner liner and the first liner seal is an inner liner seal.

8. The combustor of claim 1, wherein the first end of the first liner is a forward end and the second end of the first liner is an aft end, and wherein the first end of the first liner has a fixed seal.

9. The combustor of claim 1, wherein the first liner seal is a split ring, single piece liner seal.

10. The combustor of claim 1, wherein first portion further includes an axial flange extending from the first outer flange, the second leg of the second portion and the axial flange of the first portion defining an axial cavity for receiving one end of the second cold wall, and wherein the second cold wall is movable within the axial cavity relative to the axial flange of the first portion and the second leg of the second portion generally in the axial direction and is generally retained by the axial flange of the first portion and the second leg of the second portion in the radial direction.

11. The combustor of claim 1, wherein the second liner is an outer liner and the second liner seal is an outer liner seal.

12. A combustor for a turbine engine, comprising:

an inner liner;

an outer liner forming a combustion chamber with the inner liner, the combustion chamber configured to receive an air-fuel mixture for combustion therein and having a longitudinal axis that defines axial and radial directions, the inner liner being a dual walled liner comprising a first hot wall facing the combustion chamber and a first cold wall that forms an inner liner cavity with the first hot wall, the outer liner being a dual walled liner comprising a second hot wall facing the combustion chamber and a second cold wall that forms an outer liner cavity with the second hot wall, each of the outer and inner liner cavities having first and second ends;

an inner liner seal configured to seal the second end of the inner liner cavity and to accommodate relative movement of the first hot wall and first cold wall generally in the axial and radial directions; and an outer liner seal configured to seal the second end of the outer liner cavity and to accommodate relative movement of the second hot wall and second cold wall generally in the axial and radial directions, wherein the second hot wall includes radially extending second hot wall flange, and wherein the first liner seal comprises first and second portions, the first portion being H-shaped in cross section and defining inner and outer radial grooves, the second portion having a radial leg and an axial leg, wherein the radial leg of the second portion is positioned within the outer radial groove such that the second portion is movable within the outer radial groove generally in the radial direction and is generally retained by the first portion in the axial direction, and wherein second hot wall flange is positioned within the inner radial groove such that second hot wall flange is movable within the inner radial groove generally in the radial direction and is generally retained by the first portion in the axial direction.

13. The combustor of claim 12, wherein the first hot wall includes radially extending first and second hot wall flanges that define a first hot wall groove, and wherein the inner liner seal includes a radially extending liner seal flange positioned within the first hot wall groove such that the liner seal flange is movable within the first hot wall groove relative to the first and second hot wall flanges generally in the radial direction and is generally retained by the first and second hot wall flanges in the axial direction.

14. The combustor of claim 13, wherein the first liner seal and the first hot wall define a first axial cavity, and wherein one end of the first cold wall is positioned within the first axial cavity such that the first cold wall is movable within the first axial cavity relative to the first hot wall and inner liner seal generally in the axial direction and is generally retained by the first hot wall and inner liner seal in the radial direction.

15. The combustor of claim 12, wherein first portion further includes an axial flange, the axial leg of the second portion and the axial flange of the first portion defining an axial cavity for receiving one end of the second cold wall, and wherein the second cold wall is movable within the axial cavity relative to the axial flange of the first portion and the axial leg of the second portion generally in the axial direction and is generally retained by the axial flange of the first portion and the axial leg of the second portion in the radial direction.

16. A combustor for a turbine engine, comprising:

an inner liner;

an outer liner forming a combustion chamber with the inner liner, the combustion chamber configured to receive an air-fuel mixture for combustion therein and having a longitudinal axis that defines axial and radial directions, the inner liner being a dual walled liner comprising a first hot wall facing the combustion chamber and a first cold wall that forms an inner liner cavity with the first hot wall, the outer liner being a dual walled liner comprising a second hot wall facing the combustion chamber and a second cold wall that forms an outer liner cavity with the second hot wall, each of the outer and inner liner cavities having first and second ends;

an inner liner seal configured to seal the second end of the inner liner cavity and to accommodate relative movement of the first hot wall and first cold wall in the axial and radial directions; and an outer liner seal configured to seal the second end of the outer liner cavity and to accommodate relative movement of the second hot wall and second cold wall in the axial and radial directions, wherein the first hot wall includes radially extending first and second hot wall flanges that define a first hot wall groove, and wherein the inner liner seal includes a radially extending liner seal flange positioned within the first hot wall groove such that the liner seal flange is movable within the first hot wall groove relative to the first and second hot wall flanges in the radial direction and is generally retained by the first and second hot wall flanges in the axial direction, and wherein the first liner seal and the first hot wall define a first axial cavity, and wherein one end of the first cold wall is positioned within the first axial cavity such that the first cold wall is movable within the first axial cavity relative to the first hot wall and inner liner seal in the axial direction and is generally retained by the first hot wall and inner liner seal in the radial direction, and wherein the second hot wall includes radially extending second hot wall flange, and wherein the outer liner seal comprises first and second portions, the first portion being H-shaped in cross section and defining inner and outer radial grooves, the second portion having a radial leg and an axial leg, wherein the radial leg of the second portion is positioned within the outer radial groove such that the second portion is movable within the outer radial groove generally in the radial direction and is generally retained by the first portion in the axial direction, and wherein second hot wall flange is positioned within the inner radial groove such that second hot wall flange is movable within the inner radial groove generally in the radial direction and is generally retained by the first portion in the axial direction, and wherein first portion further includes an axial flange, the axial leg of the second portion and the axial flange of the first portion defining a second axial cavity for receiving one end of the second cold wall, and wherein the second cold wall is movable within the second axial cavity relative to the axial flange of the first portion and the axial leg of the second portion generally in the axial direction and is generally retained by the axial flange of the first portion and the axial leg of the second portion in the radial direction.

* * * * *